US008047931B2

(12) United States Patent
Yokota

(10) Patent No.: US 8,047,931 B2
(45) Date of Patent: Nov. 1, 2011

(54) GOLF CLUB HEAD

(75) Inventor: Masatoshi Yokota, Kobe (JP)

(73) Assignee: SRI Sports Limited, Kobe (JP)

( * ) Notice: Subject to any disclaimer, the term of this patent is extended or adjusted under 35 U.S.C. 154(b) by 0 days.

(21) Appl. No.: 11/808,727

(22) Filed: Jun. 12, 2007

(65) Prior Publication Data

US 2008/0009369 A1 Jan. 10, 2008

(30) Foreign Application Priority Data

Jul. 10, 2006 (JP) ..... 2006-189521

(51) Int. Cl.
*A63B 53/04* (2006.01)

(52) U.S. Cl. ..... 473/342; 473/349

(58) Field of Classification Search ..... 473/324–350
See application file for complete search history.

(56) References Cited

U.S. PATENT DOCUMENTS

| | | | | |
|---|---|---|---|---|
| 4,067,734 | A * | 1/1978 | Curtis et al. | 148/421 |
| 4,952,236 | A * | 8/1990 | Wang et al. | 148/670 |
| 5,056,705 | A * | 10/1991 | Wakita et al. | 228/176 |
| 5,346,217 | A * | 9/1994 | Tsuchiya et al. | 473/345 |
| 5,464,216 | A * | 11/1995 | Hoshi et al. | 473/349 |
| 5,861,070 | A * | 1/1999 | Reichman et al. | 148/671 |
| 6,117,204 | A * | 9/2000 | Saito et al. | 75/245 |
| 6,183,374 | B1 * | 2/2001 | Onuki et al. | 473/289 |
| 6,193,614 | B1 * | 2/2001 | Sasamoto et al. | 473/329 |
| 6,228,189 | B1 * | 5/2001 | Oyama et al. | 148/669 |
| 6,338,683 | B1 * | 1/2002 | Kosmatka | 473/329 |
| 6,533,681 | B2 * | 3/2003 | Inoue et al. | 473/342 |
| 6,605,007 | B1 * | 8/2003 | Bissonnette et al. | 473/329 |
| 6,607,693 | B1 * | 8/2003 | Saito et al. | 420/417 |
| 6,623,376 | B2 * | 9/2003 | Poynor | 473/342 |
| 6,929,566 | B2 | 8/2005 | Sano | |
| 6,966,848 | B2 * | 11/2005 | Kusumoto | 473/342 |
| 7,029,403 | B2 * | 4/2006 | Rice et al. | 473/329 |
| 7,169,059 | B2 * | 1/2007 | Rice et al. | 473/329 |
| 7,207,898 | B2 * | 4/2007 | Rice et al. | 473/329 |
| 7,214,142 | B2 * | 5/2007 | Meyer et al. | 473/332 |
| 7,250,007 | B2 * | 7/2007 | Lu | 473/329 |
| 7,261,643 | B2 * | 8/2007 | Rice et al. | 473/329 |
| 7,261,782 | B2 * | 8/2007 | Hwang et al. | 148/421 |
| 7,449,075 | B2 * | 11/2008 | Woodfield et al. | 148/671 |
| 7,753,808 | B2 * | 7/2010 | Matsunaga | 473/342 |
| 7,785,213 | B2 * | 8/2010 | Matsunaga et al. | 473/342 |
| 7,878,925 | B2 * | 2/2011 | Ogawa | 473/342 |
| 2006/0225821 | A1 * | 10/2006 | Ninomiya | 148/669 |
| 2007/0270236 | A1 * | 11/2007 | Hirano | 473/345 |

FOREIGN PATENT DOCUMENTS

| | | | |
|---|---|---|---|
| JP | 11244427 | A * | 9/1999 |
| JP | 2002-165906 | A | 6/2002 |
| JP | 2002159600 | A * | 6/2002 |
| JP | 2002325870 | A * | 11/2002 |
| JP | 2004285457 | A * | 10/2004 |
| JP | 2006230569 | A * | 9/2006 |

* cited by examiner

*Primary Examiner* — Alvin Hunter
(74) *Attorney, Agent, or Firm* — Birch, Stewart, Kolasch & Birch, LLP

(57) ABSTRACT

A golf club head comprises a face portion improved in the durability by increasing the strength of the toe-side upper region of the face portion. The face portion is formed from a unidirectionally rolled plate of a titanium alloy having alpha phase, and at least in the toe-side upper region, the titanium alloy has alpha phase crystals of a hexagonal closely packed structure whose hexagonal symmetry axis (a) is oriented in the direction of a line (k) drawn between the sweet spot (SS) and the toe end point (TP).

9 Claims, 10 Drawing Sheets

E 1 section

GOLF CLUB HEAD

BACKGROUND OF THE INVENTION

The present invention relates to a golf club head, more particularly to a structure of the face portion capable of improving the durability.

In U.S. Pat. No. 6,929,566, there is disclosed a wood-type hollow metal golf club head whose face portion is formed from an alpha+beta titanium alloy Ti-6Al-4V. The face portion is decreased in the thickness to provide so called trampoline effect at impact which increases the coefficient of restitution to increase the traveling distance of the struck ball. Although the face portion as a whole is decreased in the thickness, the central region around the sweet spot is relatively thick in order to maintain the durability of the face portion.

In spite of such relatively thick central region, there is a request for further increased durability from average golfers.

In Japanese patent application publication No. 2002-165906, there is disclosed a wood-type hollow metal golf club head whose face portion is formed from a metal plate rolled in two or more different directions. This prior art teaches that if the rolled direction is one direction, the rolled plate is decreased in the resistance to bending deformation in a specific direction, and that when the rolled direction is aligned with the heel-and-toe direction of the head, the face portion is decreased in the durability. Thus, this prior art proposed to use a metal plate rolled in two or more directions and thus having less anisotropy, and also teaches that the durability of the face portion can be improved and yet it becomes not necessary to concern the orientation of the metal plate. Further, it is suggested that the metal plate is preferably formed from a beta titanium alloy by cold rolling.

In order to improve the durability of the face portion, the present inventor investigated ball hitting positions when the average golfers made miss shots. As a result, it was found that, as shown in FIG. 2 in which the ball hitting positions are mapped excluding those in the sweet area X, there is a tendency that the positions concentrate in a region At on the upper side of the horizontal line HL passing the sweet spot SS and on the toe-side of the vertical line VL passing the sweet spot SS. In particular, the positions concentrate in a region Y around the straight line K drawn between the sweet spot SS and the toe end point TP or the farthest point from the sweet spot SS. Accordingly, it is considered that the stress and strain at impact concentrate in this toe-side upper region At.

If this toe-side upper region At is partially increased in the thickness, the durability may be improved, but the trampoline effect will be biased to deteriorate the directionality of the trajectory of the ball. If the thickness of the face portion is increased in its entirety, the durability will be increased, but this defeats the original purpose.

SUMMARY OF THE INVENTION

It is therefore, an object of the present invention to provide a golf club head in which the durability of the face portion can be improved, by increasing the strength of the toe-side upper region of the face portion, without partially increasing the thickness of this region.

According to the present invention, a golf club head comprises a face portion defining a club face for striking a ball, the club face having a sweet spot (SS) and a toe end point (TP), the toe end point (TP) positioned on the upper side of a horizontal line passing through the sweet spot (SS) and on the toe-side of a vertical line passing through the sweet spot (SS), the club face including a toe-side upper region on the upper side of the horizontal line and on the toe-side of the vertical line, wherein the toe-side upper region is formed from a unidirectionally rolled plate of a titanium alloy having alpha phase, and the unidirectionally rolled plate is oriented in the direction of a line (K) drawn between the sweet spot (SS) and the toe end point (TP) so that the angle between the rolled direction (RD) thereof and the direction of the like (K) becomes not more than 15 degrees.

In the unidirectionally rolled plate, the alpha phase crystal has a hexagonal closely packed structure. As shown in FIG. 6, the hexagonal closely packed structure has a hexagonal symmetry axis (a), and in the direction of the hexagonal symmetry axis (a), the structure is easily deformable, but in the directions (b) orthogonal thereto, the structure is hardly deformable. In the unidirectionally rolled plate, the axis (a) is oriented in the rolled direction. As a result, the unidirectionally rolled plate exhibits a remarkable anisotropy, and the tensile strength in the perpendicular direction to the rolled direction becomes higher than the tensile strength in the rolled direction, and further the tensile elastic modulus in the perpendicular direction to the rolled direction becomes higher than the tensile elastic modulus in the rolled direction.

On the other hand, as to the contour shape of the club face, the size in the direction of the straight line K (hereinafter, the "direction K") is relatively large. But, the size in the direction perpendicular to the direction K (hereinafter, the "perpendicular direction J") becomes considerably small in the toe-side upper region At, and the span becomes gradually decreased towards the point TP. Therefore, as to the strength against the flexure of the face portion at impact, the margin of the strength in the perpendicular direction J becomes smaller than the margin of the strength in the direction K from the geometrical viewpoint.

By orienting the rolled direction in the direction K, the hexagonal symmetry axes (a) of the alpha phase crystals having the hexagonal closely packed structure are also oriented in the direction K. Accordingly, the directions (b) in which the structure is hardly deformable are oriented in the perpendicular direction J. As a result, the toe-side upper region is increased in the margin of the strength in the perpendicular direction J, and the durability of this region and accordingly that of the face portion as a whole can be improved.

DEFINITIONS

In this application, the dimensions, angles, positions and the like refer to the those of the club head under the standard state unless otherwise noted.

Here, the standard state of the club head is such that the club head is set on a horizontal plane HP so that the axis CL of the club shaft (not shown) is inclined at the lie angle (beta) while keeping the axis CL on a vertical plane VP, and the club face 2 forms its loft angle (alpha) with respect to the vertical plane VP. Incidentally, in the case of the club head alone, the center line of the shaft inserting hole 7*a* can be used instead of the axis CL of the club shaft.

The sweet spot SS is the point of intersection between the club face 2 and a straight line N drawn normally to the club face 2 passing the center G of gravity of the head.

The back-and-forth direction is a direction parallel with the straight line N projected on the horizontal plane HP.

The toe-heel direction TH is a direction parallel with the horizontal plane HP and perpendicular to the back-and-forth direction.

The crown-sole direction CS is a direction perpendicular to the toe-heel direction TH, namely, a vertical direction.

The moment of inertia is the lateral moment of inertia around a vertical axis passing through the center G of gravity in the standard state.

If the edge (2*a*, 2*b*, 2*c* and 2*d*) of the club face 2 is unclear due to smooth change in the curvature, a virtual edge line (Pe) which is defined, based on the curvature change is used instead as follows. As shown in FIGS. 18 and 19, in each cutting plane E1, E2—including the straight line N extending between the sweet spot SS and the center G of gravity of the head, a point Pe at which the radius (r) of curvature of the profile line Lf of the face portion first becomes under 200 mm in the course from the center SS to the periphery of the club face is determined. Then, the virtual edge line is defined as a locus of the points Pe.

DESCRIPTION OF THE PREFERRED EMBODIMENTS

Figure 1:
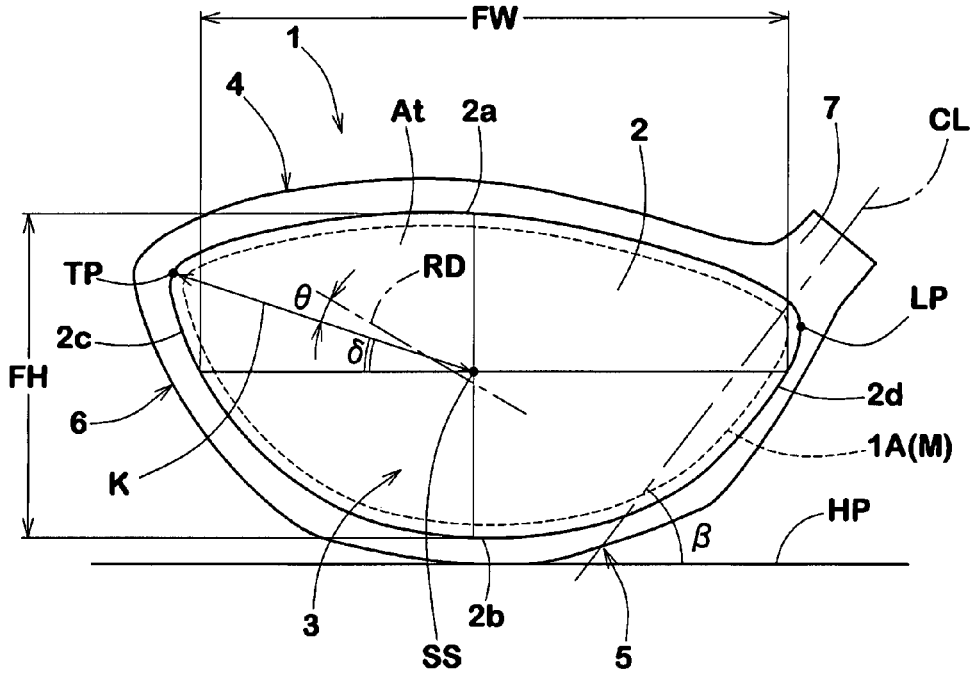
FIG. 1 is a front view of a golf club head according to the present invention.

Embodiments of the present invention will now be described in detail in conjunction with the accompanying drawings.

In the drawings, golf club head 1 according to the present invention is a hollow head for a wood-type golf club such as driver (#1) or fairway wood, and the head 1 comprises: a face portion 3 whose front face defines a club face 2 for striking a ball; a crown portion 4 intersecting the club face 2 at the upper edge 2*a* thereof; a sole portion 5 intersecting the club face 2 at the lower edge 2*b* thereof; a side portion 6 between the crown portion 4 and sole portion 5 which extends from a toe-side edge 2*c* to a heel-side edge 2*d* of the club face 2 through the back face BF of the club head; and a hosel portion 7 at the heel side end of the crown to be attached to an end of a club shaft (not shown) inserted into the shaft inserting hole 7*a*. Thus, the club head 1 is provided with a hollow (i) and a shell structure with the thin wall.

In the case of a wood-type club head for a driver (#1), it is preferable that the head volume is set in a range of not less than 400 cc, more preferably not less than 410 cc, still more preferably not less than 425 cc in order to increase the moment of inertia and the depth of the center of gravity. However, to prevent an excessive increase in the club head weight and deteriorations of swing balance and durability and further in view of golf rules or regulations, the head volume is preferably set in a range of not more than 460 cc.

The mass of the club head 1 is preferably set in a range of not less than 180 grams in view of the swing balance and rebound performance, but not more than 210 grams in view of the directionality and traveling distance of the ball.

Figure 2:
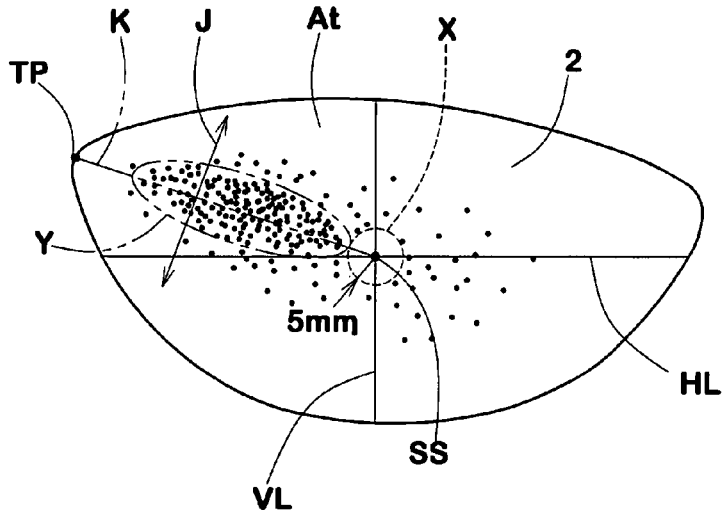
FIG. 2 is a distribution map for hitting positions by the average golfers who made bad shots.
Figure 3:
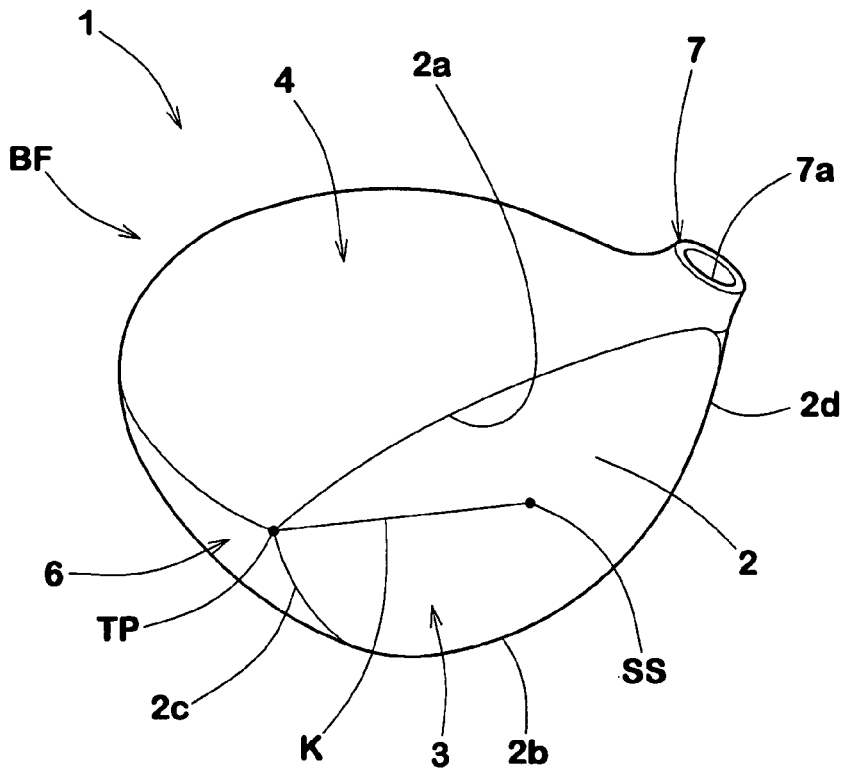
FIG. 3 is a perspective view of the head.
Figure 4:
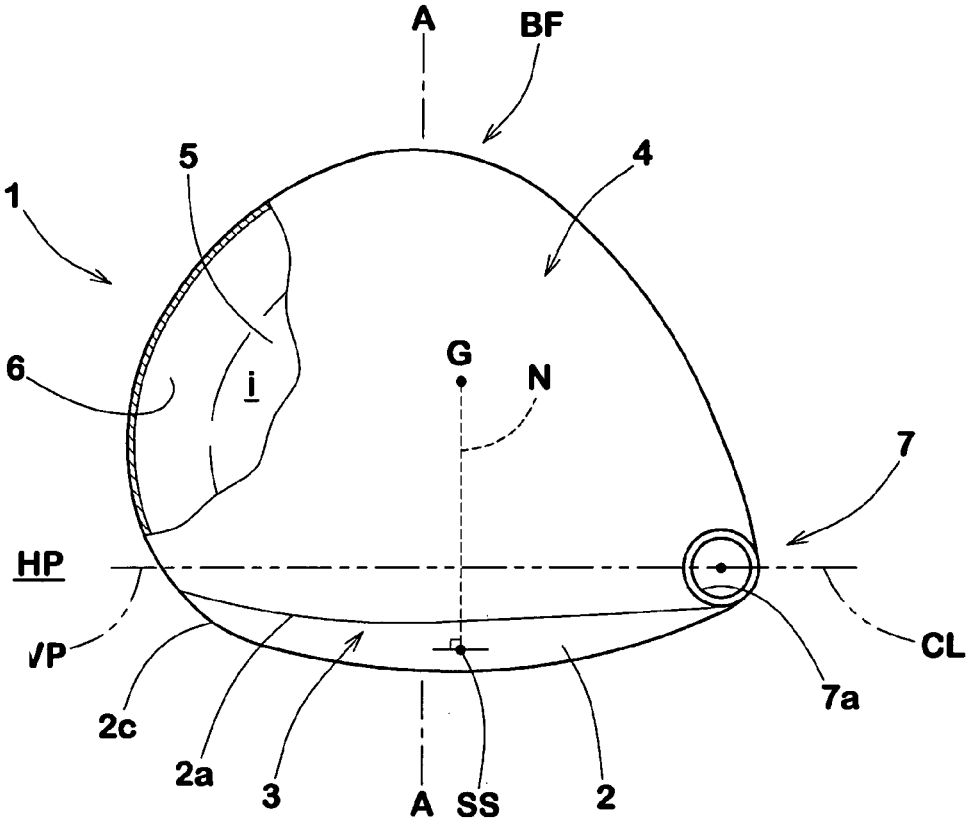
FIG. 4 is a top view thereof.

As shown in FIGS. 1 and 2, the contour shape of the club face 2 is generally oval, and wider than is height. The shape has a pointed toe end (TP) and a pointed heel end LP, both on the upper side of the horizontal line HL passing through the sweet spot SS.

The width FW of the club face 2, which is measured in the toe-heel direction along the club face 2 passing through the sweet spot SS, is preferably not less than 90.0 mm, more preferably not less than 92.0 mm, still more preferably not less than 95.0 mm, but not more than 110.0 mm, more preferably not more than 107.0 mm, still more preferably not more than 105.0 mm.

The height FH of the club face 2, which is measured in the crown-sole direction CS along the club face 2 passing through the sweet spot SS, is preferably not less than 48.0 mm, more preferably not less than 50.0 mm, still more preferably not less than 52.0 mm, but not more than 60.0 mm, more preferably not more than 58.0 mm, still more preferably not more than 56.0 mm.

Preferably, the ratio (FW/FH) is not less than 1.65, more preferably not less than 1.70, still more preferably not less than 1.80 in order to lower the center G of gravity. However, if the ratio (FW/FH) is too large, the rebound performance greatly deteriorates. Therefore, the ratio (FW/FH) is preferably not more than 2.10, more preferably not more than 2.05, still more preferably not more than 2.00.

The toe end point TP which is the farthest point on the edge of the club face 2 from the sweet spot SS on the toe-side thereof, is positioned at the above-mentioned pointed toe end such that the straight line K drawn from the sweet spot SS to the toe end point TP along the club face 2, is inclined upwardly at an angle delta of from 5 to 35 degrees with respect to the horizontal direction. Preferably, the angle delta is set in a range of not less than 10 degrees, more preferably not less than 15 degrees, but not more than 30 degrees, more preferably not more than 25 degrees.

Figure 5:
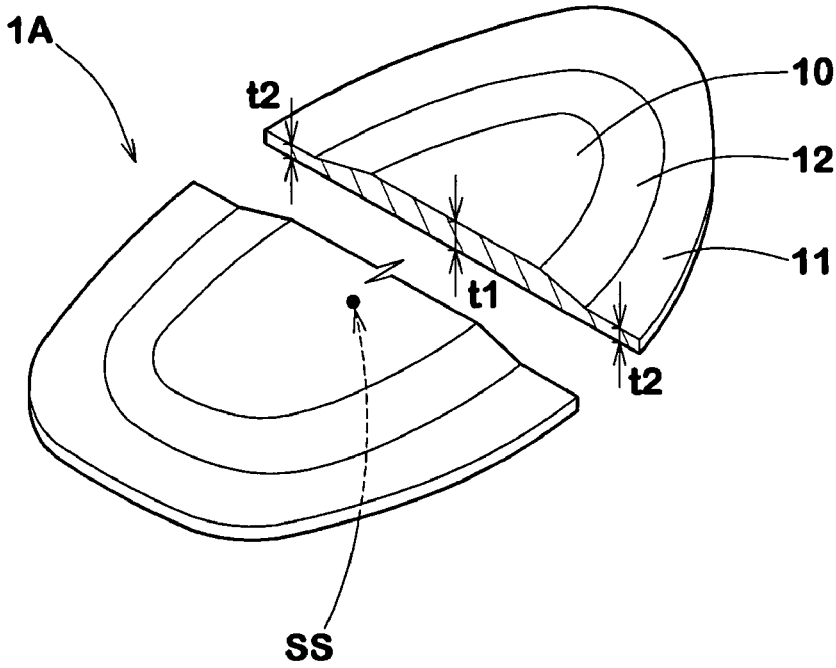
FIG. 5 is a perspective backside view of the face portion.
Figure 6:
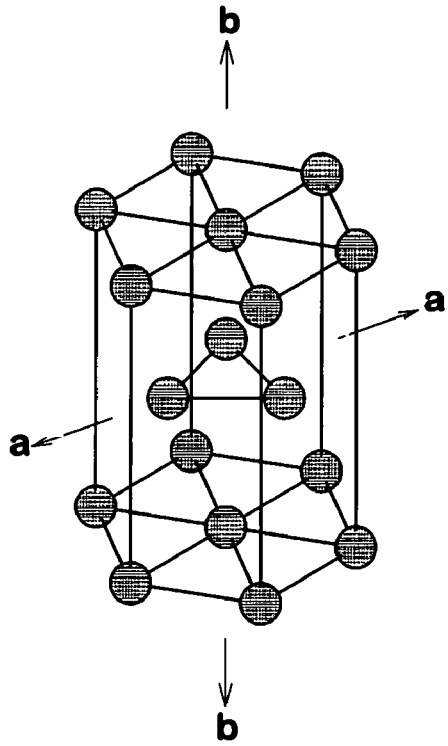
FIG. 6 is a diagram showing a hexagonal closely packed crystal structure.

FIG. 5 shows the rear surface of the face portion 3, wherein the face portion 3 is provided with a thicker central part 10 and a resultant thin annular part 11 surrounding the central part 10.

The thicker central part 10 has a contour of a similar figure to that of the face portion, and positioned such that the center (centroid) thereof becomes near or at the sweet spot SS.

The thicker central part 10 has a substantially constant thickness t1. The thickness t1 is preferably set in a range of not less than 2.80 mm, more preferably not less than 2.90 mm, still more preferably not less than 2.95 mm in view of the strength and durability, but in view of the weight increase and rebound performance, the thickness ti is preferably not more than 3.50 mm, more preferably not more than 3.30 mm, still more preferably not more than 3.15 mm.

The thin part 11 has a substantially constant thickness t2. In order to increase the flexure of the face portion 3 at impact to improve the rebound performance and at the same time to reduce the weight of the face portion 3, the thickness t2 is decreased to a value in a range of not more than 2.70 mm, more preferably not more than 2.55 mm, still more preferably not more than 2.45 mm. But, in view of the durability, especially that of the toe-side upper region At, the thickness t2 is preferably not less than 2.10 mm, more preferably not less than 2.20 mm, still more preferably not less than 2.25 mm.

Between the thicker central part 10 and thin part 11, in order to prevent a stress concentration, there is provided with a transitional zone 12 in which the thickness gradually changes from the thickness t1 of the thicker part 10 to the thickness t2 of the thin part 11.

The average thickness ta of the face portion 3 is preferably not less than 2.35 mm, more preferably not less than 2.40 mm, still more preferably not less than 2.45 mm for the strength and durability and to prevent an excessive increase of the coefficient of restitution. But, to prevent an excessive decrease of the coefficient of restitution and a decrease of the moment of inertia, the average thickness ta is preferably not more than 2.75 mm, more preferably not more than 2.70 mm, still more preferably not more than 2.65 mm.

Here, the average ta is an area weighted average which can be obtained by $$ta = \frac{\sum (Tn \times An)}{\sum An} \quad (n = 1, 2, \ldots)$$

wherein

An is the area of a minute part (n), and

Tn is the thickness of the minute part (n).

In this embodiment, the metal wood-type club head 1 is composed of a face plate 1A forming at least a part of the face portion 3, and a main shell body 1B forming the remainder of the head.

Figure 7:
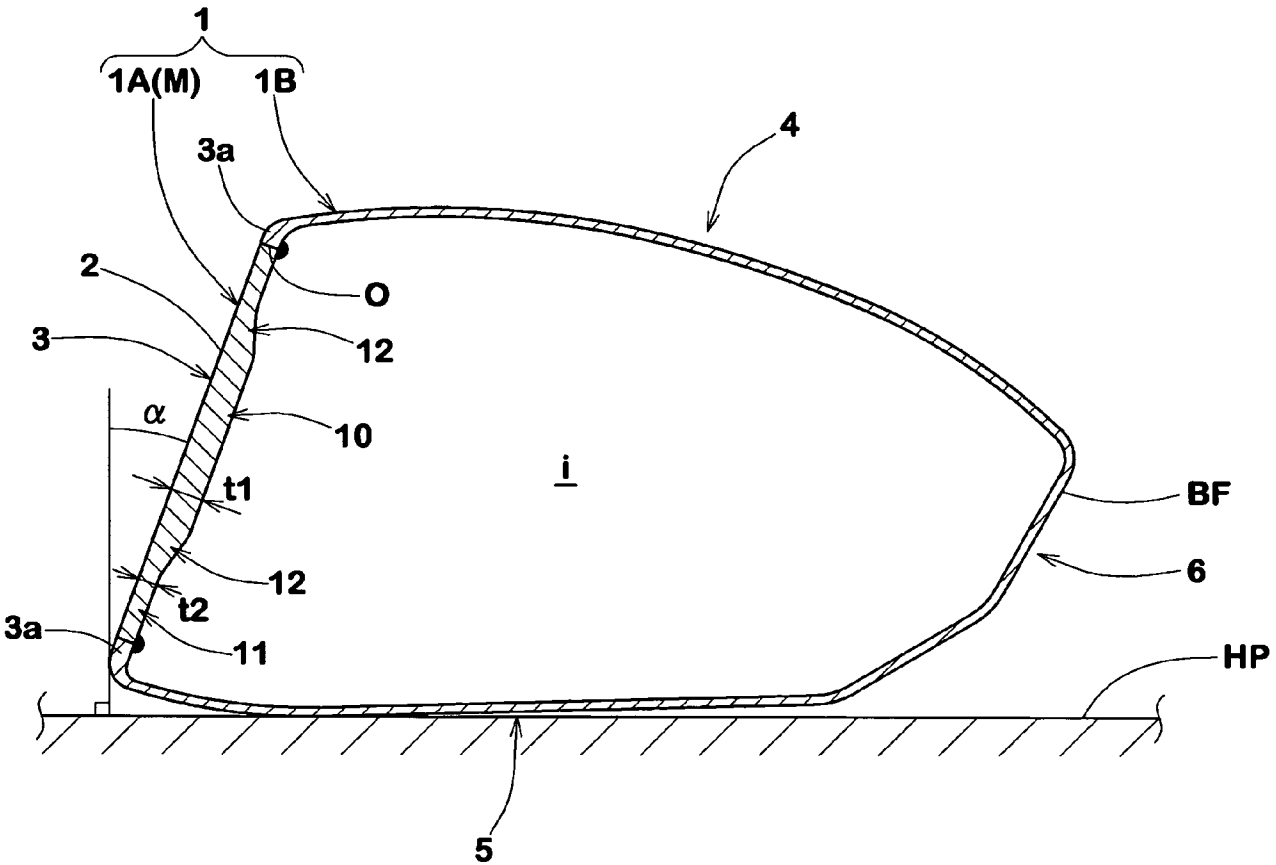
FIG. 7 is a cross sectional view taken along line A-A in FIG. 4 showing a face plate thereof.

In the case of an example shown in FIG. 7 in which the face plate 1A is provided with no turnback, the face plate 1A forms a major part of the face portion 3 excluding the peripheral edge part 3*a* thereof. In this case, it is necessary that the face plate 1A forms at least 50% (preferably 60% or more, more preferably 70% or more, (in FIG. 1 about 75%)) of the total surface area of the club face 2. In this example, the face plate 1A has a contour of a similar figure to that of the club face 2.

Figure 8:
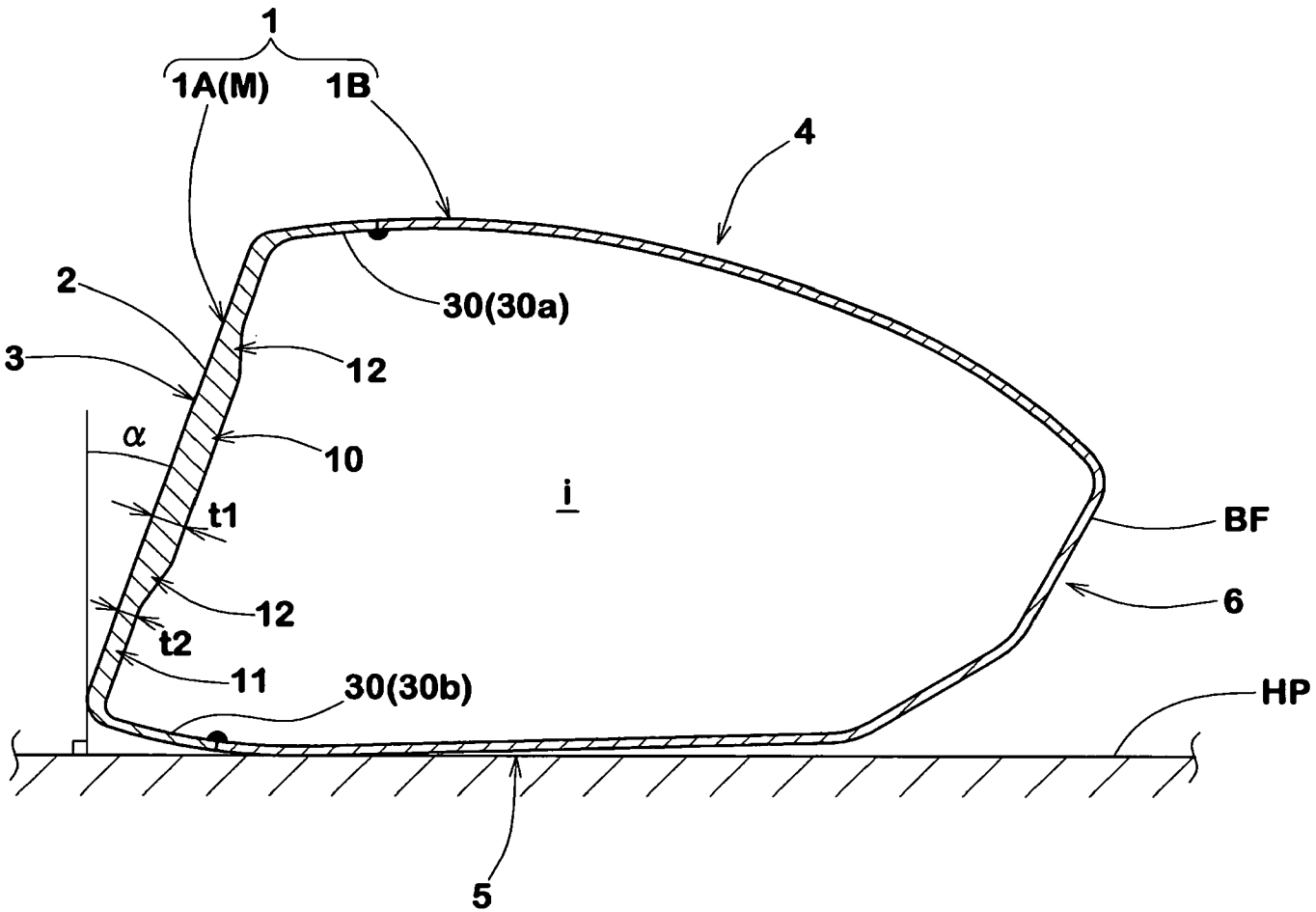
FIG. 8 is a similar cross sectional view showing another example of the face plate with a turnback.

In the case of an example shown in FIG. 8 in which the face plate 1A is provided around its main portion with a turnback 30, the entirety of the face portion 3 is formed by the face plate 1A. The turnback 30 in this example is formed along the almost entire length of the edge (2*a*, 2*b*, 2*c* and 2*d*) of the club face 2. But, it is also possible to form partially, for example, along the upper edge 2*a* and lower edge 2*b* to form a front end zone 30*a* of the crown portion 4 and a front end zone 30*b* of the sole portion 5.

The main shell body 1B is hollow and provided with a front opening 0 which is covered with the face plate 1A.

In the case of FIG. 7, the main shell body 1B includes the above-mentioned crown portion 4, sole portion 5, side portion 6 and hosel portion 7. Further, the peripheral edge part 3*a* is also included.

In the case of FIG. 8, the main shell body 1B includes a major part of the head excluding the face portion and a portion corresponding to the turnback 30.

The main shell body 1B can be a single-piece structure formed by casting or the like. Also, it can be a multi-piece structure formed by assembling two or more parts prepared by suitable processes, e.g. forging, casting, press working and the like.

To make the main shell body 1B, for example, stainless steels, maraging steels, pure titanium, titanium alloys, aluminum alloys, magnesium alloys, amorphous alloys and the like can be used alone or in combination.

A metal material weldable with the face plate 1A is preferred in view of the production efficiency. In addition, a lightweight nonmetal material such as fiber reinforced resins can be used to form a part of the main shell body 1A. Further, a separate weight member may be disposed on the main shell body 1A.

According to the present invention, at least the toe-side upper region At of the face portion 3 has to be formed by a titanium alloy having alpha phase crystals of a hexagonal closely packed structure whose hexagonal symmetry axis (a) is oriented in the direction k.

In this embodiment, therefor, the face plate 7 is made of a unidirectionally rolled plate M of a titanium alloy having alpha phase, and the rolled direction RD is substantially aligned with the above-mentioned direction K so that the angle theta between the rolled direction RD and the direction K is not more than 15 degrees, preferably not more than 10 degrees, more preferably not more than 5 degrees.

The face plate 1A has to includes at least 50%, preferably more than 60%, more preferably more than 70%, most preferably more than 80% of the toe-side upper region At.

Here, the toe-side upper region At is defined as being surrounded by the edge of the club face 2, the above-mentioned horizontal line HL and vertical line VL both passing through the sweet spot SS.

The titanium alloy having alpha phase is an alpha alloy or an alpha+beta alloy. The alpha+beta alloys include Ti-4.5Al-3V-2Fe-2Mo, Ti-4.5Al-2Mo-1.6V-0.5Fe-0.3Si-0.03C, Ti-1Fe-0.35o-0.01N, Ti-8Al-1Mo, Ti-5.5Al-1Fe, Ti-6Al-4V, Ti-6Al-6V-2Sn, Ti-6Al-2Sn-4Zr-6Mo, Ti-6Al-2Sn-4Zr-2Mo, Ti-8Al-1Mo-1V, and the like. Especially, the first three alloys are preferred because of a high specific tensile strength, and an excellent formability. A typical alpha alloy is Ti-5Al-2.5Sn.

As the alpha+beta alloys are higher in the strength than the alpha alloys, the alpha+beta alloys are especially preferable to the alpha titanium alloys because the durability of the face portion 3 can be improved, and by decreasing the thickness of the face plate 1A, the weight can be reduced and further the freedom of designing the position of the center of gravity can be increased.

The unidirectionally rolled plate M is aeolotropic, and the tensile strength Srd and tensile elastic modulus Erd in the rolled direction RD are different from the tensile strength Spd and tensile elastic modulus Epd in the perpendicular direction PD to the rolled direction RD.

If the anisotropy ratios (strength anisotropy ratio Spd/Srd and modulus anisotropy ratio Epd/Erd) are very near to 1.0, the durability can not be improved. But, if too large, the strength of the plate is decreased on the whole, the durability is rather decreased.

Therefore, the tensile strength ratio (Spd/Srd) is preferably set in a range of not less than 1.20, more preferably not less than 1.25, still more preferably not less than 1.30, but not more than 1.60, more preferably not more than 1.50, still more preferably not more than 1.45.

The elastic modulus ratio (Epd/Erd) is preferably set in a range of not less than 1.10, more preferably not less than 1.14, still more preferably not less than 1.18, but not more than 1.60, more preferably 1.55, still more preferably not more than 1.50.

If the strengths Srd and Spd are too high and/or the moduli Epd and Erd are too high, then the coefficient of restitution of the face portion becomes decreased, and the traveling distance of the ball is liable to decrease. If the strengths Srd and Spd are too low, the face portion 3 becomes liable to break early. If the moduli Epd and Erd are too low, as the coefficient of restitution is increased, there is a possibility that the head becomes incompatible with the golf rules or regulations.

Therefore, the tensile strength Spd is preferably set in a range of not less than 1000 MPa, more preferably not less than 1100 MPa, still more preferably not less than 1150 MPa, but not more than 1500 MPa, more preferably not more than 1450 MPa, still more preferably not more than 1400 MPa.

The tensile strength Srd is preferably set in a range of not less than 800 MPa, more preferably not less than 850 MPa, still more preferably not less than 900 MPa, but not more than 1200 MPa, more preferably not more than 1100 MPa, still more preferably not more than 1050 MPa.

The tensile elastic modulus Epd is preferably set in a range of not less than 115 GPa, more preferably not less than 120 GPa, still more preferably not less than 125 GPa, but not more than 170 GPa, more preferably not more than 165 GPa, still more preferably not more than 160 GPa.

The tensile elastic modulus Erd is preferably set in a range of not less than 90 GPa, more preferably not less than 95 GPa, still more preferably not less than 100 GPa, but not more than 125 GPa, more preferably not more than 120 GPa, still more preferably not more than 118 GPa.

Figure 9:
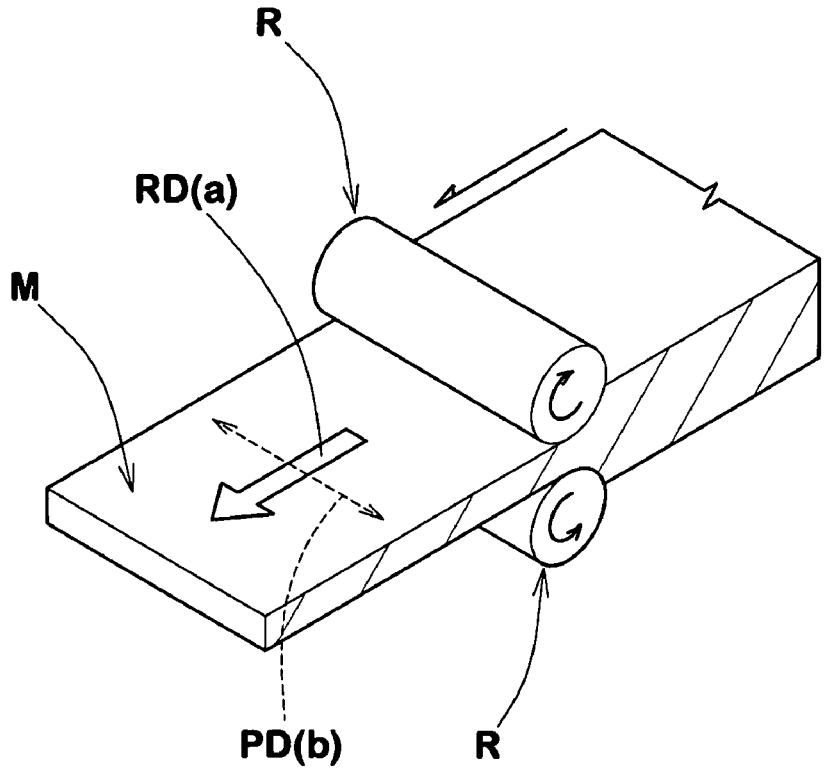
FIGS. 9 and 10 are diagrams for explaining a method for manufacturing a primary face plate 14.

The unidirectionally rolled plate M is, as shown in FIG. 9, produced by passing the above-mentioned titanium alloy material through between opposed pressure rollers R plural times without changing the passing direction.

Therefore, the hexagonal closely packed structure in the material is orientated such that the hexagonal symmetry axes (a) of the hexagonal close packing crystals are oriented in the rolled direction RD. As a result, the unidirectionally rolled plate exhibits a remarkable anisotropy, and the tensile strength in the perpendicular direction PD to the rolled direction RD becomes higher than the tensile strength in the rolled direction RD, and the tensile elastic modulus in the perpendicular direction PD to the rolled direction RD becomes higher than the tensile elastic modulus in the rolled direction RD.

When rolled in only one direction, in comparison with the beta titanium alloys, a titanium alloy having alpha phase displays a significant anisotropy in the strength. In order to utilize this strength anisotropy, the rolled direction RD of the unidirectionally rolled plate M is oriented in the direction K so that the above-mentioned direction (b) is orientated in the direction J perpendicular to the direction K namely, orientated in the direction in which the margin of the strength is less. AS a result the durability can be improved. Incidentally, the use of the unidirectionally rolled plate M in the face portion 3 has advantages such that the thickness of the face portion 3 as a whole can be reduced to improve the rebound performance. Further, the weight of the face portion 3 can be reduced to deepen the center of gravity of the head.

The rolling process may be worked out with one or the other of hot rolling and cold rolling which are defined as being carried out with the material temperature of over 200 degrees C. and under 200 degrees C., respectively. But, it is desirable that the hot rolling and cold rolling are combined as follows: firstly, hot rolling is carried out 2 to 7 times by heating the material up to a temperature range between 700 and 1000 degrees C.; and then, cold rolling is carried out 5 to 7 times at the material temperature in a range of from under 200 degrees C. to ambient temperature.

In any case, the total number of times to roll is preferably not less than 7, more preferably not less than 9, but not more than 15, more preferably not more than 12.

The rolling ratio is preferably not less than 20%, more preferably not less than 25%, still more preferably not less than 30%, but, not more than 50%, more preferably not more than 45%, still more preferably not more than 40%. Here, the rolling ratio (%) (or reduction of rolling) is:

$$(h1-h2)\times 100/h1$$

wherein h1 is the thickness before rolled, and h2 is the finished thickness of the rolled plate.

Therefore, crystal grains which are inhomogeneous structures and deposited metals in the rolled plate are fractured, and the crystalline structure of the rolled plate is compacted. As a result, the strength and toughness can be improved.

If the rolling ratio is less than 20%, the crystal grains as inhomogeneous structures and deposited metals in the rolled plate can not be fully fractured. Further, the orientation of the hexagonal closely packed crystal structures becomes insufficient. Therefore, the strength anisotropy becomes weak. If the rolling ratio is more than 50%, the rolled plate becomes brittle and liable to crack.

If the total number of times to roll is less than 7, the crystalline structure of the rolled plate can not be fully homogenized and there is a possibility that the strength anisotropy can not be fully displayed. If the total number is more than 15, the surface of the rolled plate tends to be covered with a thick oxidized film because the titanium alloy is active.

Incidentally, the material to be rolled can be prepared by various ways, e.g. fusion casting, forging, and the like. It is possible that the material undergoes a heat treatment, machine work and the like.

Figure 10:
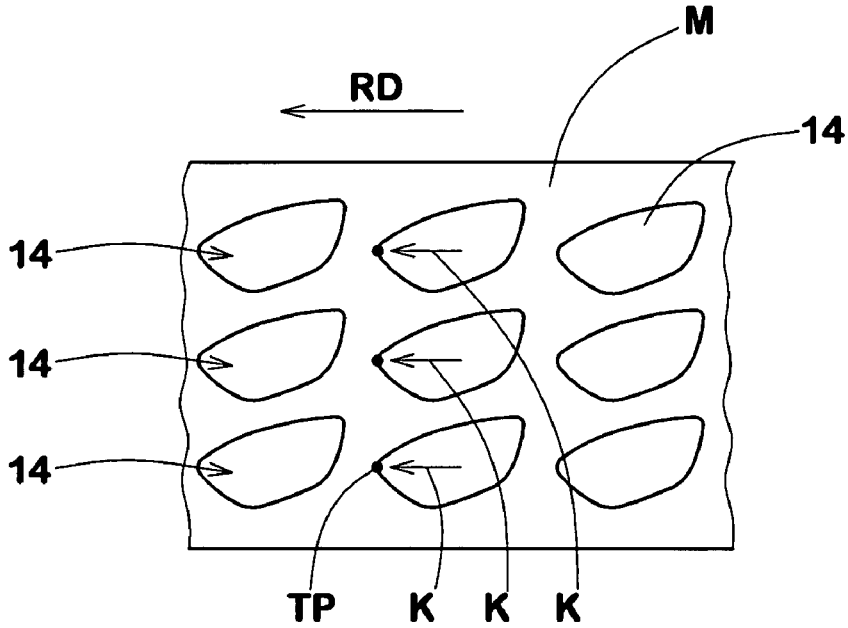

As shown in FIG. 10, from the unidirectionally rolled plate M, primary face plates 14 are formed by utilizing punch cutting die, laser cutting or the like so that the direction K becomes in parallel with the rolled direction RD.

As the rolled plate M has a constant thickness, in the case of the face portion 3 having the above-mentioned variable thickness, in order to change the thickness, cutting, plastic forming or the like can be utilized.

In the case of cutting, for example, using a NC milling machine, the primary face plate 14 is partially reduced in the thickness to form the thin part 11 and thickness transitional zone 12.

Figure 11:
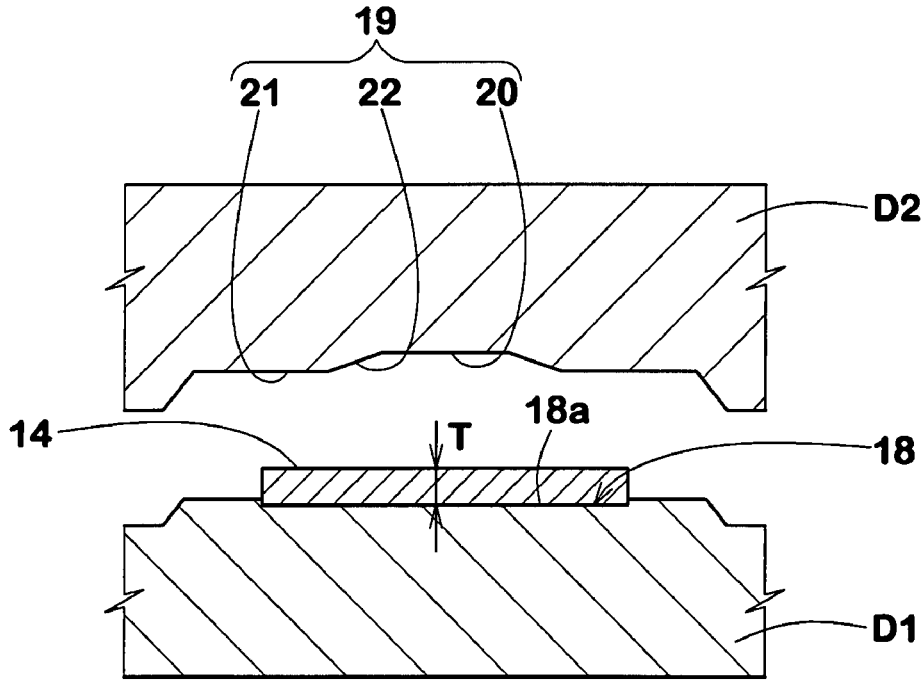
FIGS. 11 and 12 are schematic cross sectional views for explaining a method for manufacturing the face plate shown in FIG. 7 by press molding the primary face plate 14.
Figure 12:
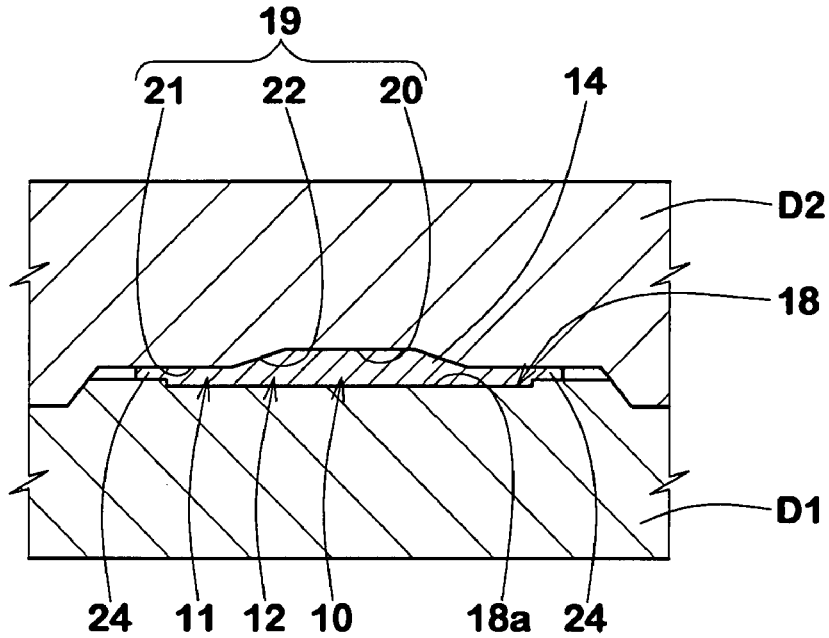

In the case of plastic forming, the thin part 11 and thickness transitional zone 12 can be formed by using a pressing machine comprising a lower press die D1 and an upper press die D2 as shown in FIGS. 11 and 12.

The lower press die D1 is provided with a first surface 18 for shaping the club face. The first surface 18 is recessed, and the primary face plate 14 can be fitted therein. The upper press die D2 is provided with a second surface 19 for shaping the rear surface of the face portion 3. Therefore, The second surface 19 includes a surface 20 for shaping the thicker central part 10, a surface 21 for shaping the thin part 11, and a surface 22 for shaping the thickness transitional zone 12.

The primary face plate 14 is placed between the first surface 18 and second surface 19 and compressed so that the thickness is reduced in the thin part 11 and transitional zone 12. The surplus material may be extruded as an extrusion 24.

When the club face 2 has a bulge and/or a roll, the first surface 18 and second surface 19 are curved correspondingly. It is of course also possible to provide the bulge and/or roll in a separate process before or after this plastic forming process. Likewise, in the former case, the bulge and/or roll can be provided before or after, preferably before the cutting process, utilizing a die press machine.

FIGS. 11 and 12 show the dies for the face plate 1A shown in FIG. 7.

Figure 13:
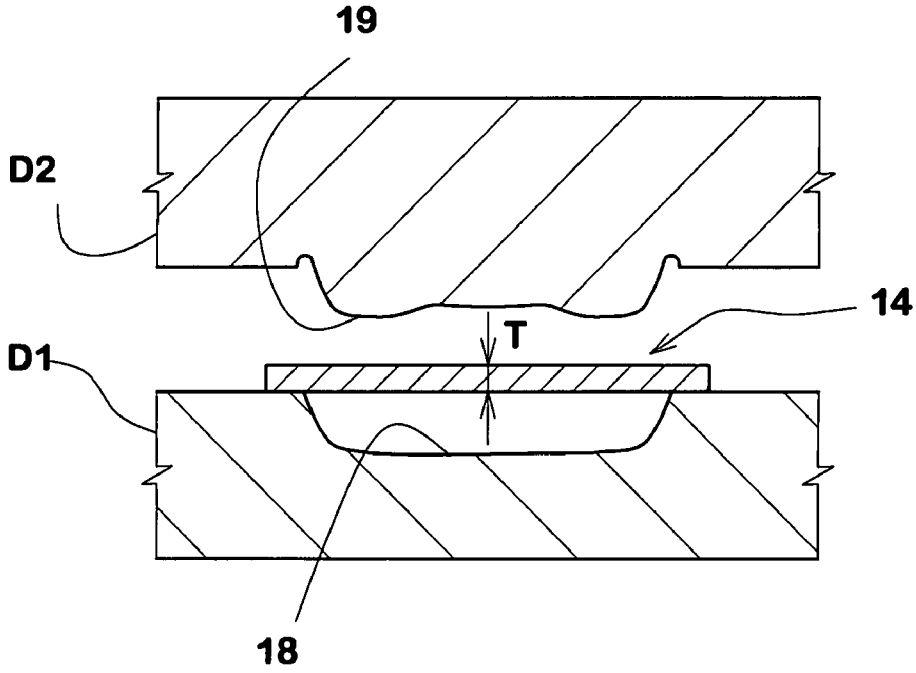
FIGS. 13 and 14 are schematic cross sectional views for explaining a method for manufacturing the face plate shown in FIG. 8 by press molding the primary face plate 14.
Figure 14:
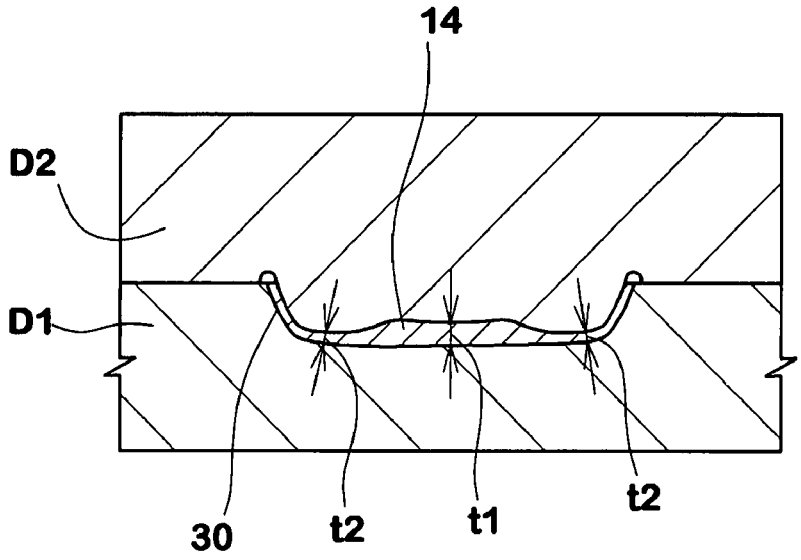

In the case of the face plate 1A provided with the turnback 30 shown in FIG. 8, as shown in FIGS. 13 and 14, the dies D1 and D2 having shaping surfaces 18 and 19 corresponding to the shape of such cup-type face plate 1A are used.

In the plastic forming, the thin part 11 and thickness transitional zone 12 make compressive deformation more than the thicker central part 10. Thus, the anisotropy of the thin part 11 is furthered, and the strength of the thin part 11 is increased. As a result, the face portion 3 as a whole is further improved in the strength. Further, by the compressed deformation, the face portion 3 is increased in the elastic modulus, which can prevent the coefficient of restitution from increasing. Thus, even if the face portion 3 is decreased in the thickness, it is possible to conform to the golf rules change.

fore, the face plate had a constant thickness of 2.5 mm throughout. The angle delta was 20 degrees. The primary face plate 14 as the face plate was fixed to the main shell body by plasma arc welding.

Figure 17:
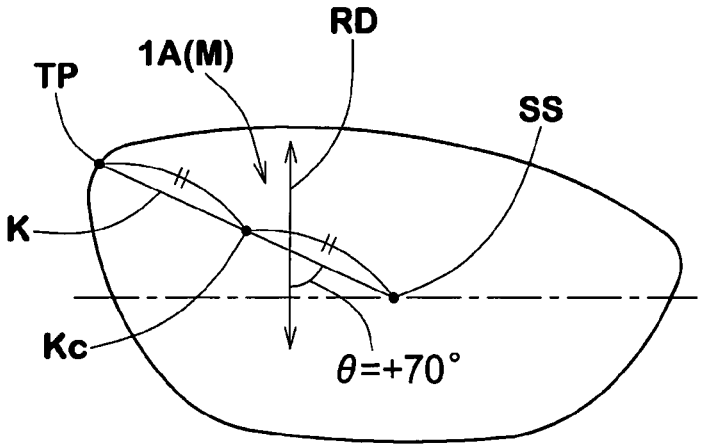
Figure 18:
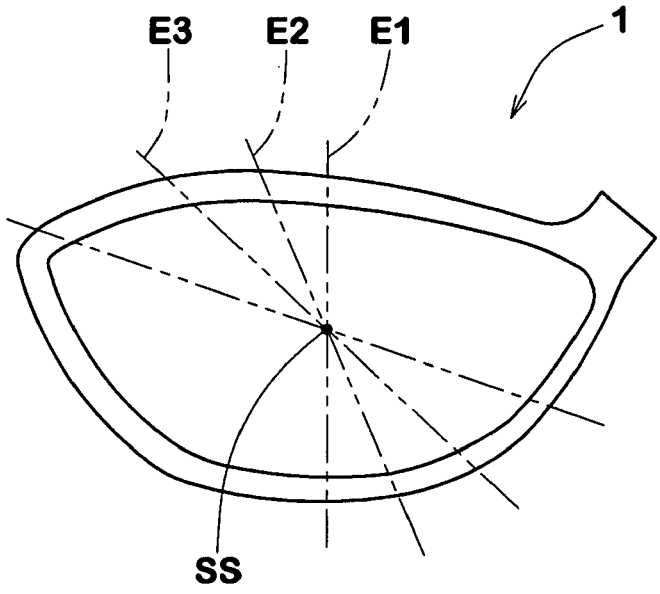
FIG. 18 and FIG. 19 are a front view and a cross-sectional view for explaining the definition of the edge of the club face.
Figure 19:
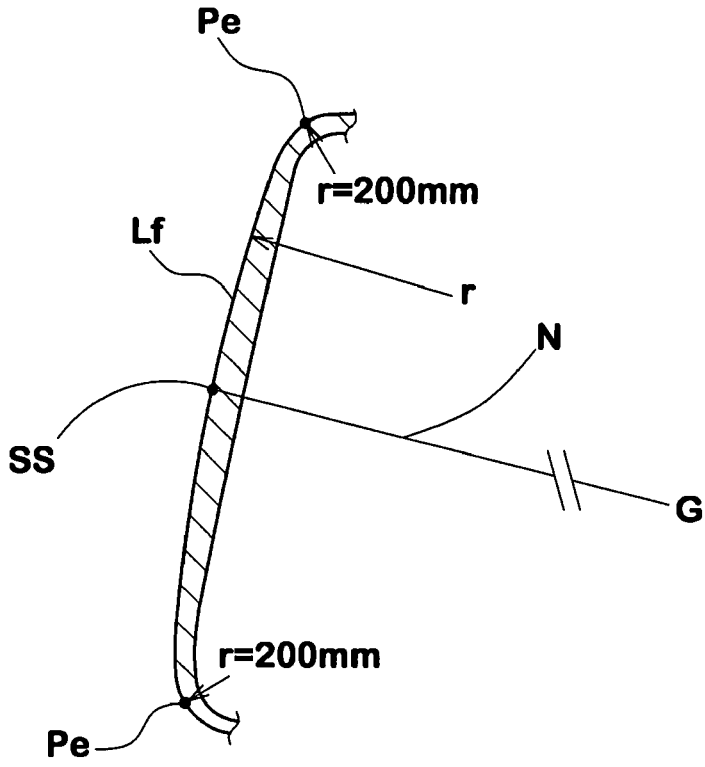

Durability Test:

Each head was attached to a FRP shaft (SRI sports Ltd. V-25, Flex x) to make a 45-inch wood club, and the golf club was mounted on a swing robot and hit golf balls 10000 times at the maximum, while visually checking the face portion every 100 times. The hitting position was set at the middle point Kc on the straight line K between the sweet spot SS and toe end point TP as shown in FIG. 17. The head speed at impact was 54 meter/second.

The results are shown in Table 1, wherein "A" means that no damage was found after the 10000-time hitting test, and numerical values mean the number of hits at which the face portion was broken.

TABLE 1

Figure 15:
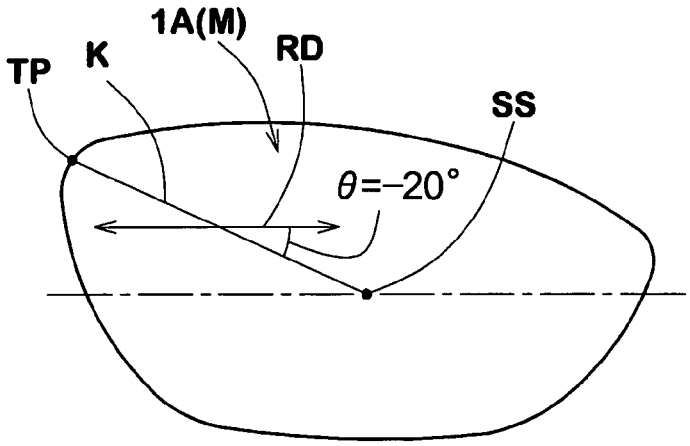
FIGS. 15, 16 and 17 are front views each showing the oriented direction of the unidirectionally rolled plate.
Figure 16:
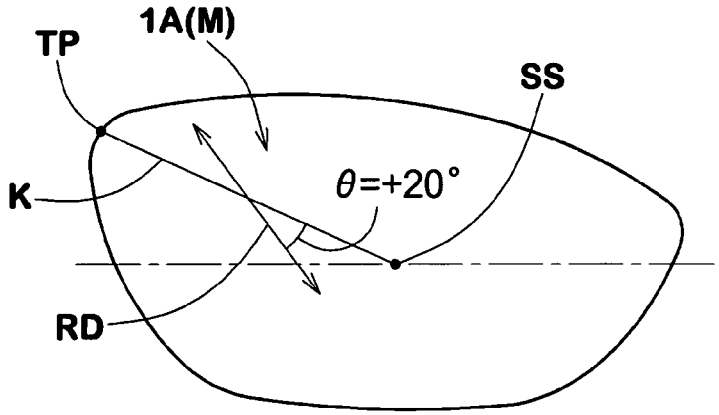

| Head | Ref. 1 FIG. 15 | Ex. 1 | Ex. 2 | Ex. 3 | Ex. 4 | Ex. 5 | Ex. 6 | Ex. 7 | Ref. 2 FIG. 16 | Ref. 3 FIG. 17 |
|---|---|---|---|---|---|---|---|---|---|---|
| Angle theta *1 (deg.) | −20 | −15 | −10 | −5 | 0 | +5 | +10 | +15 | +20 | +70 |
| Durability | 7900 | 9300 | A | A | A | A | A | 8900 | 5100 | 4700 |

*1 Plus sign: Clockwise from Direction K Minus sign: Counterclockwise from Direction K The face plate 1A and main shell body 1B produced as above are fixed to each other. For that purpose, welding (Tig welding, plasma welding, laser welding, etc.), soldering, press fitting and the like can be used alone or in combination. Especially, laser welding is preferred.

Comparison Tests

Wood club heads (Loft angle alpha: 11 degrees, Lie angle beta: 57.5 degrees, Head volume: 450 cc) having the structure shown in FIG. 7 (no turnback) and the specifications shown in Table 1 were made and tested for the durability.

All of the heads had identical main shell bodies which were a lost-wax precision casting of a titanium alloy Ti-6Al-4V. From the following unidirectionally rolled plate, primary face plates 14 were punched out with dies, changing the angle theta.

From the test results, it was confirmed that the durability of the face portion can be remarkably improved by setting the angle theta within a narrow range.

As has been explained hereinabove, the present invention is suitably applied to wood-type hollow metal heads regardless of the face portion having a constant thickness or a variable thickness. But, it is also possible to apply the invention to various heads, for instance iron-type heads.

The invention claimed is:

1. A method for manufacturing a golf club head having a club face having a sweet spot (SS) and a toe end point (TP), comprising:

designing a contour shape of the club face so that the club face has a pointed toe end on the upper side of a hori-

| Manufacturing method and Properties of Unidirectionally rolled plate | |
|---|---|
| Material: | Ti—4.5Al—2Mo—1.6V—0.5Fe—0.3Si—0.03C (alpha + beta titanium alloy) |
| Rolling: | 11 stages |
| In 1st to 5th rolling stages, material temperature: | 840 degrees C. |
| In 6th to 11th rolling stages, material temperature: | 150 degrees C. |
| Final thickness of the rolled plate: | 2.5 mm |
| Rolling ratio (reduction): | 50% |
| In rolled direction RD, | |
| tensile strength Srd: | 1000 MPa |
| tensile elastic modulus Erd: | 105 GPa |
| In perpendicular direction PD | |
| tensile strength Spd: | 1330 MPa |
| tensile elastic modulus Epd: | 155 GPa |
| Strength anisotropy ratio Spd/Srd: | 1.33 |
| Modulus anisotropy ratio Epd/Erd: | 1.48 |

In the comparison tests, in order to evaluate the effect of the purely orientation on the durability, each face plate was not provided with a thickness variation as shown in FIG. 5. Therezontal line (HL) drawn passing through the sweet spot (SS) such that said toe end point (TP) which is the farthest point on the edge of the club face from the sweet spot (SS) on the toe-side thereof is positioned at the pointed toe end, and a straight line (K) drawn from the sweet spot (SS) to said toe end point (TP) is inclined at an angle (delta) of from 15 to 35 degrees with respect to the horizontal line, cutting out a primary face plate for forming the club face from a unidirectionally rolled plate of an alpha+beta titanium alloy having a rolled direction (RD) such that said straight line (K) becomes in parallel with the rolled direction (RD), wherein said titanium alloy has alpha phase crystals of a hexagonal closely packed structure whose hexagonal symmetry axis is oriented in the rolled direction (RD), forming a thicker central part and a thin annular part of the face plate by depressing the rear surface of the primary face plate with a die pressing machine, and making the golf club head by using the pressed cut-out face plate and a main shell body to which the face plate is fixed.

2. The method according to claim 1, in which the thicker central part has a substantially constant thickness of not less than 2.80 mm but not more than 3.50 mm, and the thin part has a substantially constant thickness of not more than 2.70 mm but not less than 2.10 mm.

3. The method according to claim 1 or 2, which further comprises:

forming said main shell body by casting a metal material as a single-piece structure provided with a front opening, and welding the face plate to the main shell body so that the front opening is covered with the face plate.

4. The method according to claim 1, wherein the primary face plate is provided with a bulge and/or a roll of the club face by plastic forming as a separate process after the process of forming the thicker central part and the thin annular part.

5. A method for manufacturing a golf club head, the golf club head comprising a face portion defining a club face for striking a ball, the club face having a sweet spot (SS) and a toe end point (TP), wherein the toe end point (TP) is positioned on the upper side of a horizontal line passing through the sweet spot (SS) and on the toe-side of a vertical line passing through the sweet spot (SS), and a straight line (K) drawn from the sweet spot (SS) to said toe end point (TP) is inclined at an angle (delta) of from 15 to 35 degrees with respect to the horizontal line, the method comprising the steps of:

cutting out a primary face plate for forming the club face from a unidirectionally rolled plate of a titanium alloy having a rolled direction (RD) such that said straight line (K) becomes in parallel with the rolled direction (RD), providing a variable thickness for the face portion by plastic forming of the primary face plate using a pressing machine, or alternatively by cutting of the primary face plate using a NC milling machine, providing curvature of a bulge and/or a roll for the club face by plastic forming of the primary face plate provided with the variable thickness, and making the golf club head by using the curved face plate and a main shell body to which the face plate is fixed.

6. The method according to claim 5, which further comprises:

forming said main shell body by casting a metal material as a single-piece structure provided with a front opening, and welding the face plate to the main shell body so that the front opening is covered with the face plate.

7. The method according to claim 5, wherein the unidirectionally rolled plate has a modulus anisotropy ratio Epd/Erd between the tensile elastic modulus Erd in the rolled direction (RD) and the tensile elastic modulus Epd in the perpendicular direction (PD) to the rolled direction is not less than 1.10, but not more than 1.60.

8. The method according to claim 5 or 7, wherein the unidirectionally rolled plate has strength anisotropy ratio Spd/Srd between the tensile strength Srd in the rolled direction (RD) and the tensile strength Spd in the perpendicular direction (PD) to the rolled direction is not less than 1.20, but not more than 1.60.

9. The method according to claim 5, wherein in the step of providing the variable thickness, the face portion is provided with a thicker central part having a thickness of not less than 2.80 mm but not more than 3.50 mm, and a thin part having a thickness of not more than 2.70 mm but not less than 2.10 mm.

* * * * *